US006189935B1

(12) United States Patent
Oberholzer et al.

(10) Patent No.: US 6,189,935 B1
(45) **Date of Patent: *Feb. 20, 2001**

(54) PRINTABLE TAG WITH INTEGRAL FASTENER

(75) Inventors: John Carson Oberholzer, Brighton, MI (US); Kevin Charles Lacek, River Falls, WI (US)

(73) Assignee: Lowry Computer Products, Inc., Brighton, MI (US)

( * ) Notice: Under 35 U.S.C. 154(b), the term of this patent shall be extended for 0 days.

This patent is subject to a terminal disclaimer.

(21) Appl. No.: 09/257,285

(22) Filed: Feb. 25, 1999

(51) Int. Cl.[7] ..... B42D 15/00

(52) U.S. Cl. ..... 283/80; 283/79; 283/74; 40/299; 40/673; 40/299.01

(58) Field of Search ..... 283/74, 79, 80; 40/299, 673, 299.01

(56) References Cited

U.S. PATENT DOCUMENTS

| | | | | |
|---|---|---|---|---|
| 261,164 | * | 7/1882 | Lynk . | |
| 281,733 | * | 7/1883 | Sears . | |
| D. 317,181 | * | 5/1991 | Nozawa | D20/22 |
| 324,388 | * | 8/1885 | Joslin . | |
| 627,920 | * | 6/1899 | Gould . | |
| 876,294 | * | 1/1908 | Brown et al. . | |
| 1,309,904 | * | 7/1919 | Mills et al. . | |
| 1,324,568 | * | 12/1919 | Shelton . | |
| 1,506,956 | * | 9/1924 | Thompson . | |
| 2,183,799 | * | 12/1939 | Wenk, Jr. . | |
| 2,768,458 | * | 10/1956 | Anania . | |
| 3,550,295 | * | 12/1970 | Anania . | |
| 3,837,101 | * | 9/1974 | Young | 40/302 |
| 4,142,310 | * | 3/1979 | Groselak | 40/302 |
| 4,630,384 | * | 12/1986 | Breen | 40/21 R |
| 4,726,131 | * | 2/1988 | Cass | 283/80 |
| 4,914,843 | * | 4/1990 | Dewoskin | 40/633 |
| 5,104,148 | | 4/1992 | Neal | 283/81 |
| 5,141,254 | * | 8/1992 | Ring | 283/105 |
| 5,151,403 | | 9/1992 | Suzuki et al. | 503/200 |
| 5,271,642 | | 12/1993 | Jahier et al. | 283/81 |
| 5,381,617 | * | 1/1995 | Schwartztol et al. | 40/6 |
| 5,538,289 | | 7/1996 | Cassis, III | 283/74 |
| 5,673,943 | | 10/1997 | Campbell | 283/79 |
| 5,782,496 | * | 7/1998 | Casper et al. | 283/81 |

* cited by examiner

*Primary Examiner*—Henry Tsai
*Assistant Examiner*—Alisa L. Thurston
(74) *Attorney, Agent, or Firm*—Harness, Dickey & Pierce, P.L.C.

(57) ABSTRACT

The printable substrate of biaxially multi-layered laminate material is perforated to define an integral strap having a free end for insertion into a crescent-cut slotted opening. An additional perforation defines an optional, removable index card that may be printed upon when the tag itself is printed. The tag substrate may be provided as a continuous web that has been perforated to define multiple tags, suitable for printing and dispensing by automated mechanism.

12 Claims, 4 Drawing Sheets

PRINTABLE TAG WITH INTEGRAL FASTENER

BACKGROUND AND SUMMARY OF THE INVENTION

The present invention relates generally to tags and labels. More particularly, the invention relates to a printable tag with integral fastener suitable for being printed and dispensed by mechanical means. The integral fastener allows the tag to be quickly attached to goods, shipping containers or dunnage, without the need to install a separate string or wire fastener.

Shipping tags and labels are used throughout industry for inventory control, shipping origin and destination addressing, component identification, just-in-time manufacturing, specimen labeling, and the like. Traditionally, most industries have used a simple paper tag with separate wire or string fastener, designed to be written on by hand and then attached to the article. Although this paper tag can be printed on and dispensed mechanically, the wire or string fastener must be installed separately so as not to jam the feeding and printing apparatus.

With the prevalence of many inventory management systems, process flow control systems and shipping systems now operating under computer control, there is considerable interest in a printable tag that works in this automated environment. Desirably, the tag should be printed and dispensed as part of the automated manufacturing, shipping and/or storage process, with the tag being ready for immediate application to the article. In this way, accurate correlation between the tag and the article is ensured and the manufacturing, shipping and/or storage process proceeds efficiently.

To meet the needs of today's automated environments, the invention provides a printable tag with integral fastener that requires no separate string or wire fastener. The tag employs a printable substrate that is provided with a first perforation which separates to define a slotted opening in the substrate. A second perforation, extending laterally adjacent to one edge of the substrate, separates to define an elongated strap that has an end sized to fit within the slotted opening.

In use, the tag is applied by breaking the perforations through a quick zipping action, to free one end and the intervening body of the strap from the printable substrate. The opposite end of the strap remains attached to the substrate. The strap is then wrapped or looped around the article to be tagged, and the free end of the strap is inserted into the slotted opening.

The elongated strap is provided with a series of spaced-apart notches that interlock with the slotted opening to secure the strap in place. The strap may be secured loosely around the article, or it may be pulled tight by pulling on the free end of the strap.

The presently preferred tag is a biaxially multi-layered laminate of polyethylene with a matte top coating to support printing by suitable thermal printer or laser printer.

For a more complete understanding of the invention, its objects and advantages, refer to the following specification and to the accompanying drawings.

DESCRIPTION OF THE PREFERRED EMBODIMENTS

Figure 1:
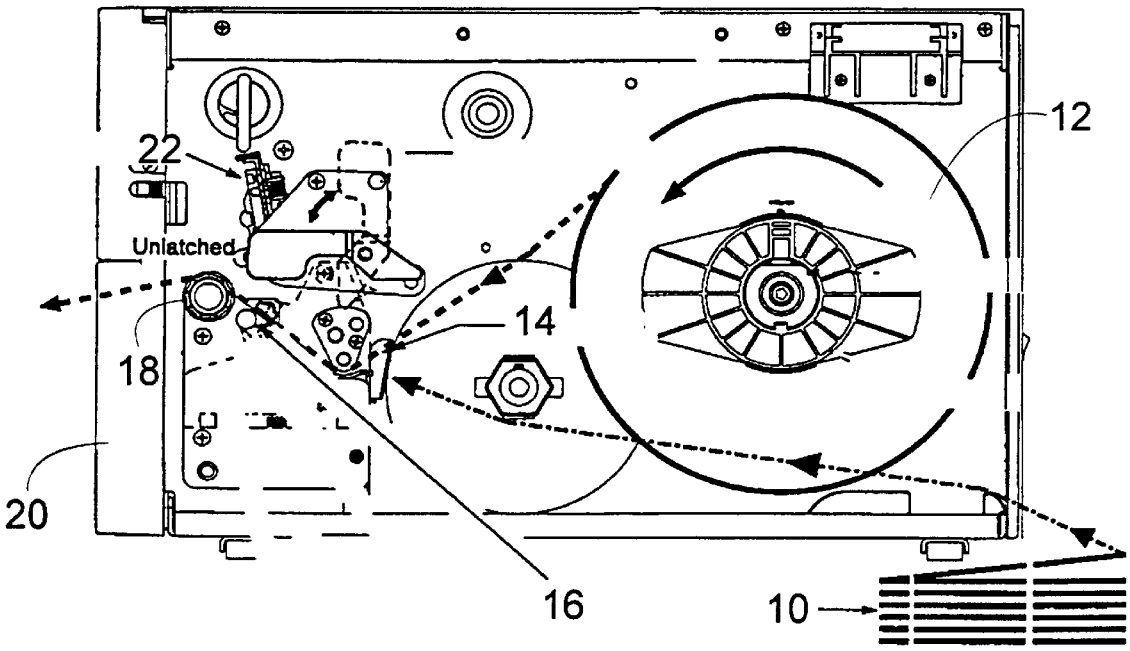
FIG. 1 is a cross-sectional view of an exemplary printing and labeling apparatus useful in understanding how the printable tag of the invention may be deployed.

The printable tag of the invention may be deployed manually or by mechanized printing and dispensing apparatus. Such apparatus is illustrated in FIG. 1, in which the printable tag of the invention is illustrated in fanfold form at 10 and in roll form at 12. In both forms the tag stock comprises a perforated web of tags arranged end-to-end.

Whether provided in fanfold form or roll form, the tag media is fed through the printing and dispensing mechanism as illustrated by the broken lines in FIG. 1. Specifically, the tag media is passed through media guide 14, past the media edge sensor 16, around the capstan 18 and out through the front of the dispensing mechanism 20. The dispensing mechanism can be provided with a print mechanism or print head 22 that applies printed information, such as alphanumeric text or barcode information to the printable surface of the tag substrate.

Figure 2:
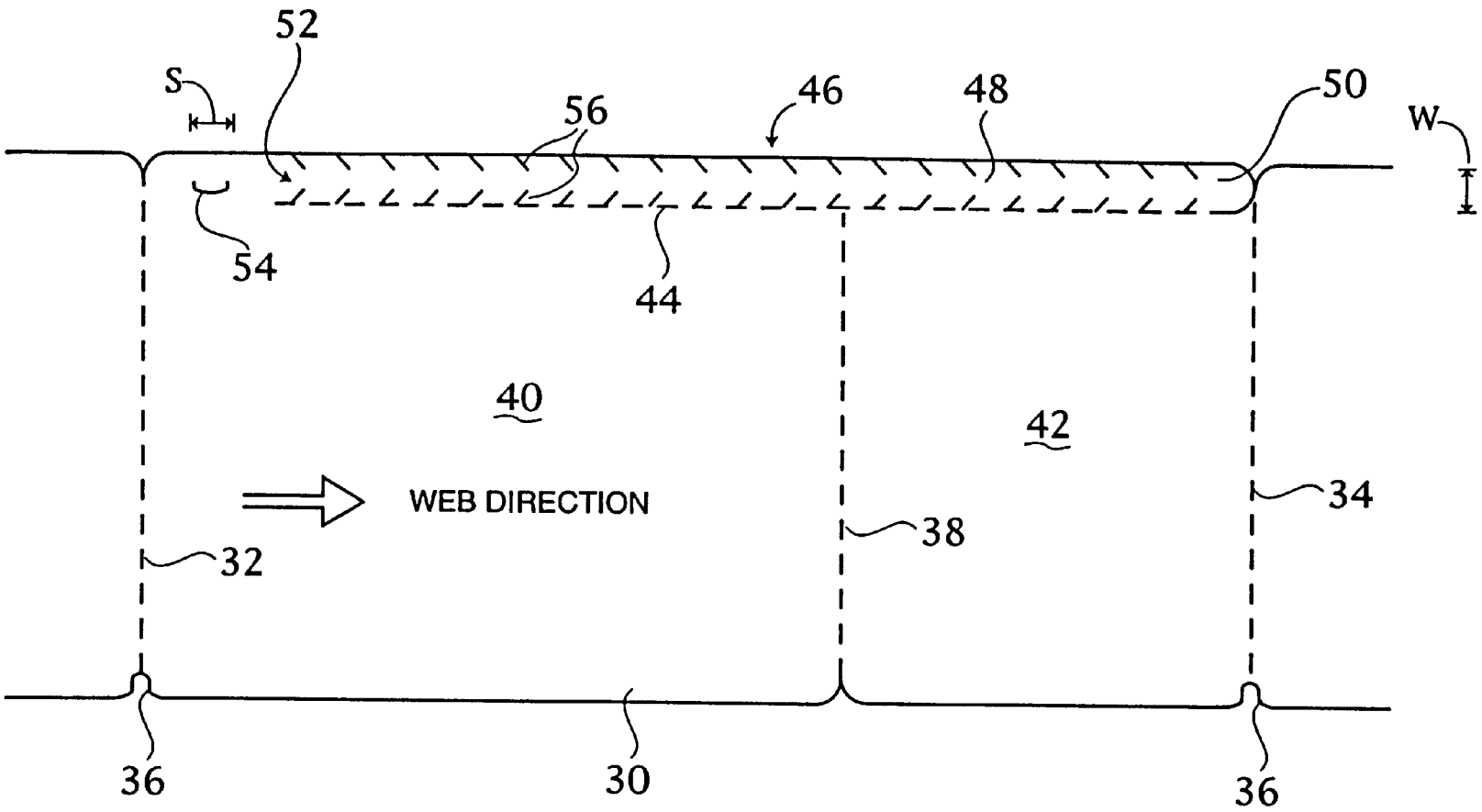
FIG. 2 is a plan view of the printable tag according to the presently preferred embodiment thereof.
Figure 3A:
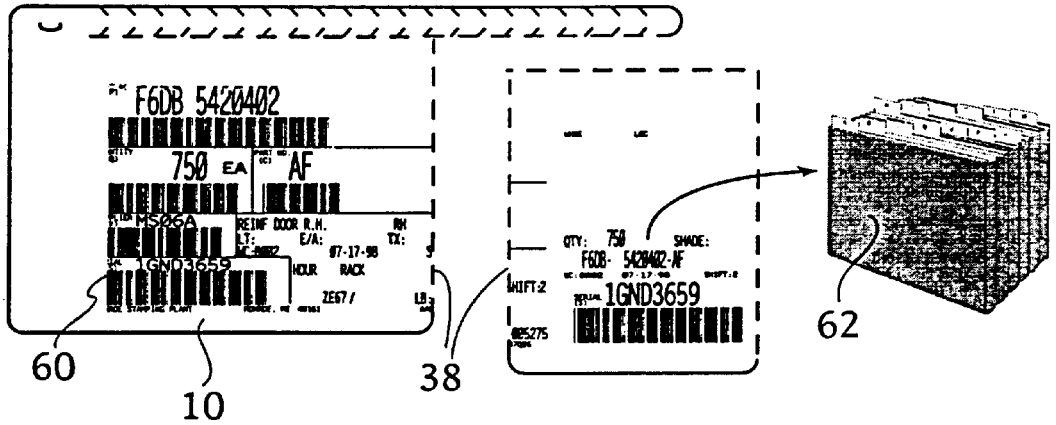
FIGS. 3*a*–3*d* illustrate the use of the tag.
Figure 3B:
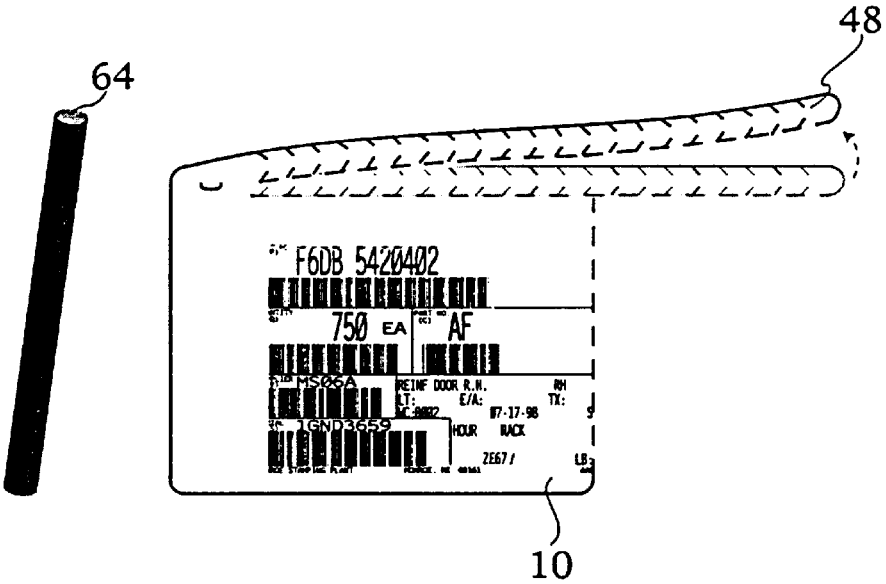
Figure 3C:
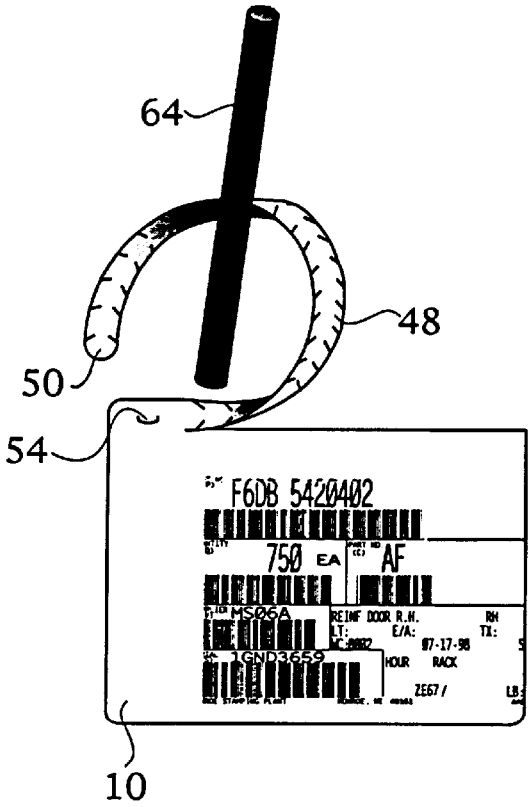
Figure 3D:
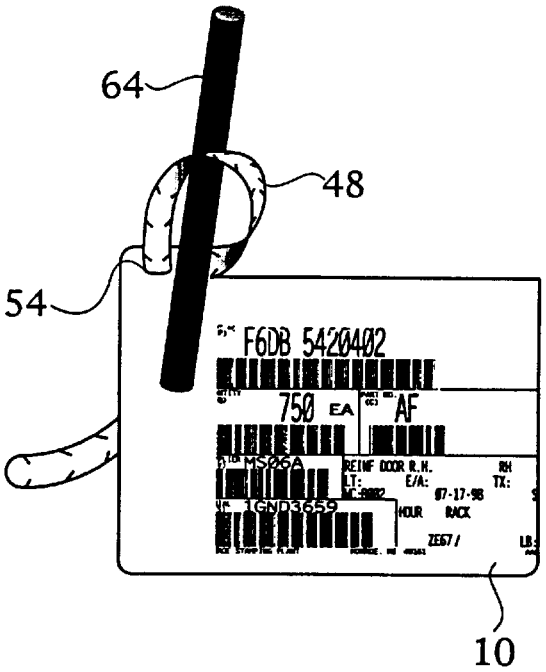

Referring to FIG. 2, the printable tag comprises a die cut printable substrate 30 that defines an elongated web of material from which a plurality of tags are constructed. The presently preferred substrate is a biaxially multi-layered laminate of polyethylene. Suitable material can be obtained from Van Leer Flexible Packaging, Houston, Texas. Under the tradename Valeron. The multi-layered laminate is virtually tearproof, because the individual laminate layers are arranged so that the grain of one layer is orthogonal to the grain of the next layer. The presently preferred embodiment employs at least one matte finish top coating, to allow the tag to be printed on by thermal printing or laser printing means.

The substrate is perforated, as at 32 and 34, generally perpendicular to the longitudinal dimension of the substrate. Perforations 32 and 34 thus define the left and right side edges of a single tag. Direction of web travel has been indicated in FIG. 2.

Along one longitudinal edge of the tag are formed a series of media sensor notches 36. Preferably, these notches coincide with perforations 32 and 34 and are used by the media edge sensor 16 (FIG. 1) to notify the printing and dispensing mechanism where one tag ends and the next tag begins.

In addition to perforations 32 and 34, the substrate may optionally be provided with a perforation 38 that may be separated to subdivide the tag into a first tag body portion 40 and a second index card portion 42. The separable index card may be printed with information that corresponds to information printed on the tag body portion 40, thereby allowing an index card record to be made of articles that have been tagged using the printable tag of the invention.

In addition to the above described perforations 32, 34 and 38, the printable substrate is provided with a perforation 44 that extends laterally adjacent first edge 46 of substrate 30. Perforation 44 separates to define an elongated strap 48. When perforation 44 is separated, strap 48 has a free end 50 and an attached end 52.

Adjacent attached end 52, substrate 30 has a slotted opening 54 defined by a crescent-cut perforation. The width w of elongated strap 48 is sized to fit within the slotted opening 54 (dimension s). In the preferred embodiment, dimension s may be slightly smaller than dimension w and the elongated strap 48 is provided with a plurality of notches or diagonal cuts 56, along one or both edges of the strap.

These diagonal cuts interlock with the crescent-cut slotted opening 54 to retain the tag once it is installed as described below.

More specifically, the crescent-cut corners of slotted opening 54 allow the substrate material between the crescent-shaped ends to bend upwardly to form a tongue. The crescent cuts should be sufficient to allow the tongue to lift upwardly, allowing the strap 48 to be easily pulled through slotted opening 54, while retaining sufficient tension to engage one or a pair of the diagonal cuts 56. The design is such that the strap may be readily pulled in a first direction to tighten the strap. The diagonal cuts lock under the tongue when pulled in the opposite direction, preventing the strap from being easily pulled loose.

Operation

Referring to FIGS. 3*a*–3*d*, printing 60 is applied to tag 10 using a suitable print engine such as the one illustrated in FIG. 1. Thereafter, perforation 38 (if provided) may be separated to remove the index card for suitable filing as at 62. The index card feature is optional or not required in some applications. Perforation 44 is likewise separated to free the elongated strap 48.

The strap 48 is then wrapped around the article to be tagged. In this case a vertical frame member of a wire basket 64 has been illustrated. The free end 50 of strap 48 is then inserted through slotted opening 54, by folding one corner of the free end and inserting it through the slotted opening. The inserted free end is then pulled to the desired tightness, allowing the notches to interlock with the tongue formed by the crescent cuts of slotted opening 54. This holds the tag securely in place and the interlocking action between notches 56 and tongue prevent the tag from being readily removed.

While the invention has been described in its presently preferred form, it will be understood that certain modifications can be made to the printable tag without departing from the spirit of the invention as set forth in the appended claims.

What is claimed is:

1. A printable tag with integral fastener, comprising:

a printable substrate having a first edge, a first perforation formed in said substrate that separates to define a slotted opening in said substrate;

a second perforation formed in said substrate extending laterally adjacent said first edge that separates to define an elongated strap, wherein said elongated strap has a free end sized to fit within said slotted opening and an opposite end attached to said substrate.

2. The tag of claim 1 wherein said elongated strap defines at least one notch adapted for interlocking with said slotted opening to secure the free end of said elongated strap within said slotted opening.

3. The tag of claim 1 further comprising at least one third perforation in said substrate along said first edge that defines at least one notch adapted for interlocking with said slotted opening to secure the free end of said elongated strap within said slotted opening.

4. The tag of claim 1 further comprising a third perforation in said substrate that separates to define a removable index card separate from said printable tag.

5. The tag of claim 1 wherein said printable substrate carries printed information.

6. The tag of claim 4 wherein said printable substrate carries printed information on both said printable tag and said index card.

7. The tag of claim 6 wherein said printed information is placed on said substrate prior to separation of said third perforation thereby ensuring that printed information on said index card corresponds to printed information on said printable tag.

8. The tag of claim 1 wherein said printable substrate is a polyethylene material.

9. The tag of claim 1 further comprising a third perforation formed in said substrate that extends substantially perpendicular to said second perforation and that separates to define a removable index card separate from said printable tag.

10. The tag of claim 1 further comprising a third perforation formed in said substrate that defines a first edge of said printable tag substantially perpendicular to said elongated strap.

11. The tag of claim 10 wherein said elongated strap extends substantially beyond said first edge of said printable tag.

12. The tag of claim 1 wherein said substrate comprises a machine feedable perforated web.

* * * * *